US009411283B2

(12) United States Patent
Mogi

(10) Patent No.: US 9,411,283 B2
(45) Date of Patent: Aug. 9, 2016

(54) FIXING DEVICE AND CONTROL DEVICE

(71) Applicant: CANON KABUSHIKI KAISHA, Tokyo (JP)

(72) Inventor: Keisuke Mogi, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/013,419

(22) Filed: Aug. 29, 2013

(65) Prior Publication Data

US 2014/0064787 A1 Mar. 6, 2014

(30) Foreign Application Priority Data

Sep. 6, 2012 (JP) ..... 2012-195664

(51) Int. Cl.
*G03G 15/16* (2006.01)
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
CPC ..... G03G 15/2053; G03G 15/2064; G03G 2215/2035
USPC ..... 399/122, 329
See application file for complete search history.

(56) References Cited

U.S. PATENT DOCUMENTS

| | | | | |
|---|---|---|---|---|
| 7,596,334 | B2 * | 9/2009 | Yoshino et al. | 399/67 |
| 7,937,013 | B2 * | 5/2011 | Lee | 399/90 |
| 8,554,097 | B2 | 10/2013 | Hara et al. | |
| 2002/0118982 | A1 * | 8/2002 | Fuma | 399/329 |
| 2005/0271432 | A1 | 12/2005 | Chiba | |
| 2007/0231026 | A1 * | 10/2007 | Hayashi et al. | 399/329 |
| 2009/0123203 | A1 * | 5/2009 | Tanaka et al. | 399/330 |
| 2010/0278551 | A1 * | 11/2010 | Maruko et al. | 399/68 |
| 2010/0296828 | A1 * | 11/2010 | Hara et al. | 399/69 |
| 2011/0013936 | A1 * | 1/2011 | Fujii | 399/122 |
| 2011/0020033 | A1 * | 1/2011 | Nagase et al. | 399/122 |
| 2011/0058861 | A1 * | 3/2011 | Suzuki | 399/328 |
| 2012/0063822 | A1 * | 3/2012 | Funabiki et al. | 399/323 |
| 2012/0301170 | A1 * | 11/2012 | Kasamatsu et al. | 399/68 |
| 2013/0148994 | A1 * | 6/2013 | Fukai | 399/67 |
| 2014/0037308 | A1 | 2/2014 | Nawa et al. | |
| 2014/0064755 | A1 | 3/2014 | Mogi | |
| 2014/0064786 | A1 | 3/2014 | Mogi | |
| 2014/0064788 | A1 | 3/2014 | Mogi | |

FOREIGN PATENT DOCUMENTS

| | | | | |
|---|---|---|---|---|
| JP | 2000194216 A | * | 7/2000 | G03G 15/20 |
| JP | 2005-351939 A | | 12/2005 | |
| JP | 2007148336 A | * | 6/2007 | |

OTHER PUBLICATIONS

Machine translation of JP 2004287317 A.*

* cited by examiner

*Primary Examiner* — David Bolduc
(74) *Attorney, Agent, or Firm* — Fitzpatrick, Cella, Harper & Scinto

(57) ABSTRACT

A fixing device includes a fixing unit including a first roller and a second roller which form a nip to fix a toner image on a sheet, the fixing unit being capable of fixing the toner image on a maximum width sheet and a small width sheet; a reciprocating mechanism for reciprocating the fixing unit in a widthwise direction; and an operating device for operating the reciprocating mechanism, wherein the operating device operates the reciprocating mechanism for a fixing operation on the small width sheet, and the operating device does not operate the reciprocating mechanism for the fixing operation on the maximum width sheet.

20 Claims, 10 Drawing Sheets

FIXING DEVICE AND CONTROL DEVICE

FIELD OF THE INVENTION AND RELATED ART

The present invention relates to a fixing device and a control device for an image forming apparatus such as a copying machine, a printer, a facsimile machine or a complex machine having a plurality of functions of those machines. In the image forming apparatus for forming an image through an electrophotographic type process, an image forming station forms a toner image, transfers the toner image onto a recording material (sheet) and fixes the toner image on the recording material by heating the recording material having the transferred toner image by a fixing device, In such a fixing device, when the recording material is nipped by a nip, lateral edge portions (edges of widthwise ends) of recording material is in contact with a fixing member (rotatable member). At this time, the surface of the fixing member tends to be damaged by the lateral edge portion of recording material.

When such a damage by the edge of recording materials having a small width occurs, the resulting unsmoothness of the surface of the fixing member appears on a large width recording material subsequently processed.

In order to reduce the influence of the damage by the lateral edge, Japanese Laid-open Patent Application 2005-351939) proposes that an entirety fixing device (pair of rotatable members) is reciprocated in the widthwise direction of recording material.

Generally, in the fixing device, lengths of the fixing member and the heating source are determined so as to process the maximum width recording material.

If the proposal of Japanese Laid-open Patent Application 2005-351939 is employed for the fixing process on the recording material of the maximum width, the device may be upsized.

For example, in the case that the fixing process is executed on the maximum width recording material in the state that the fixing device (pair of rotatable members) is at one end of the reciprocable range thereof, the widthwise center portion of the fixing device (pair of rotatable members) is offset from the widthwise center portion of the recording material. Under the circumstances, it is required that the length of fixing device and the length of the heating source for heating the fixing member (one of rotatable members) are extended in the widthwise direction to properly carry out the fixing process even if the offset occurs. This would result in the upsizing of the device.

SUMMARY OF THE INVENTION

According to an aspect of the present invention, there is provided a fixing device comprising a fixing unit including a first rotatable member and a second rotatable member which form a nip to fix a toner image on a sheet, said fixing unit being capable of fixing the toner image on a maximum width sheet having a width for which said fixing unit is operable and a small width sheet having a width smaller than the maximum width; a reciprocating mechanism configured to reciprocate said fixing unit in a widthwise direction; and an operating device configured to operate said reciprocating mechanism, wherein said operating device operates said reciprocating mechanism for a fixing operation on the small width sheet, and said operating device does not operate said reciprocating mechanism for the fixing operation on the maximum width sheet.

These and other objects, features, and advantages of the present invention will become more apparent upon consideration of the following DESCRIPTION OF THE EMBODIMENTS of the present invention, taken in conjunction with the accompanying drawings.

DESCRIPTION OF THE EMBODIMENTS

Figure 1:
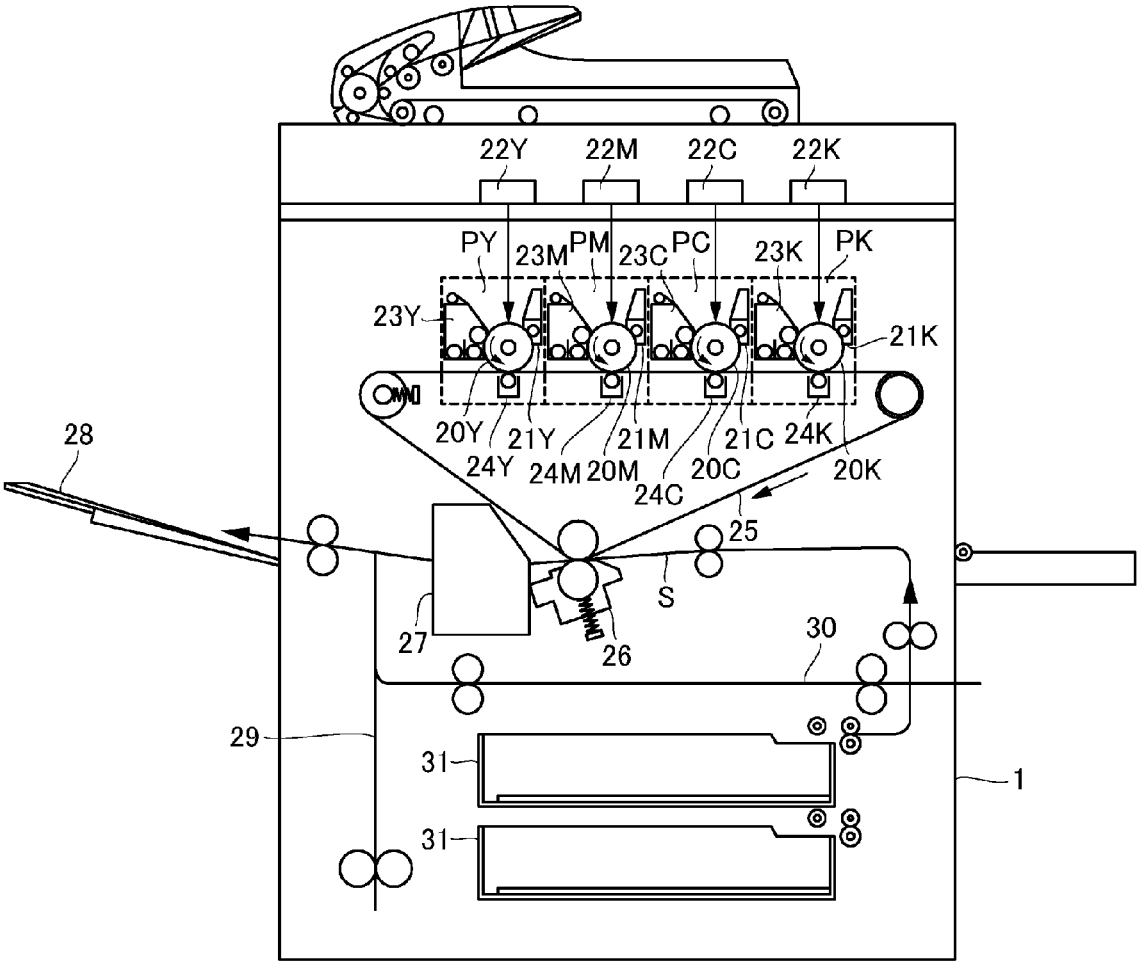
FIG. 1 is a schematic sectional view of an image forming apparatus.

Referring to FIG. 1 to FIG. 10, an embodiment of the present invention will be described. Referring to FIG. 1, an image forming apparatus according to this embodiment will be described.

[Image Forming Apparatus]

The image forming apparatus 1 comprises a fixing device 27 as an image heating apparatus which fixes an unfixed image transferred onto a recording material (sheet) S such as paper by applying heat and pressure. In this embodiment, the image forming apparatus is of a full-color and intermediary transfer type, but the present invention is applicable to another type image forming apparatus comprising an image heating device.

The image forming apparatus 1 is tandem type in which image forming stations PY, PM, PC, PK for forming Y (yellow), M (magenta), C (cyan), K (black) toner images, respectively are provided. The image forming stations PY, PM, PC, PK are arranged along a rotational moving direction of an intermediary transfer belt 25 as an intermediary transfer member and carry out the toner image the processes for the respective colors in parallel.

The image forming stations have fundamentally the same structures, and therefore, the following description of the image forming stations applies commonly to them, although suffixes Y, M, C and K are added in the drawings and only when necessary.

The image forming station P includes a photosensitive drum 20 as an image bearing member on which a toner image is formed and carried. Around the photosensitive drum 20, there are provided a charging device 21, a developing device 23, a primary transferring device 24 (unshown) and a cleaner. Above the image forming apparatus 1, an exposure device 22 is provided.

Photosensitive drum 20 is rotated in the direction indicated by the arrow in the Figure, during which a surface of the photosensitive drum 20 is uniformly charged to a predetermined potential by the charging device 21. Thereafter, the charged surface of the photosensitive drum 20 is exposed so that an electrostatic latent image is formed on the photosensitive drum 20. The electrostatic latent image on the photosensitive drum 20 is developed with a developer by the developing device 23 into a visualized toner image.

The toner image formed by the developing device 20 is primary-transferred superposingly on an endless intermediary transfer belt 25 from the photosensitive drum 20 by a primary transferring device 24. The toner images above intermediary transfer belt 25 are secondary-transferred all together onto the recording material S by a secondary transfer device 26. The surface of the photosensitive drum 20 after the primary transfer and the surface of the intermediary transfer belt 25 after the secondary transfer are cleaned by the cleaner (unshown) to be prepared for the next image formation.

The recording material S is fed to a secondary transfer portion comprising a secondary transfer device 26 and the intermediary transfer belt 25, by a feeding means such as a feeding roller, from a sheet feeding cassette 31. After the secondary transfer, the recording material S carrying the toner image is fed to the fixing device 27. The fixing device 27 heats and presses the unfixed toner image to melt and soften it, thus fixing it on the recording material S. The recording material S having the fixed toner image is discharged to a sheet discharge tray 28. When an image is to be formed also on the back side of the recording material S, the recording material S is reverted by a recording material reversing path 29 and is refed to the secondary transfer portion along the duplex print feeding path 30, where it receives the side on the back side.

As described in the foregoing, a series of image forming process operations including the charging, the exposure, the development, the transfer and the fixing is executed to form the image on the recording material S. If the image forming apparatus is a monochromatic image forming apparatus, only a black image forming station is provided. The structures and the order of the Y, M, C, K image forming stations are not limited to those described above.

[Fixing Device]

Figure 2:
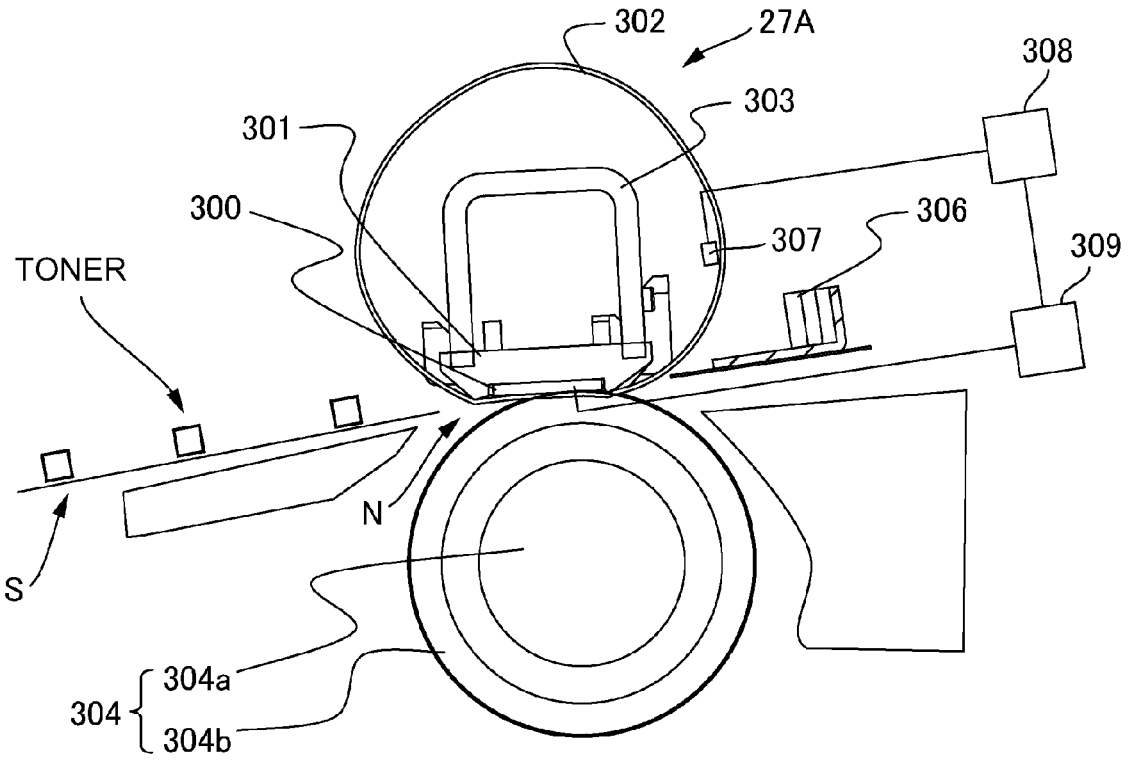
FIG. 2 is a schematic sectional view of a heating unit of a fixing device.

Referring to FIG. 2 through FIG. 5, the fixing device 27 and a heating unit 27A of the fixing device 27 according to this embodiment will be described. As shown in FIG. 2, the heating unit (fixing unit) 27A comprises an endless heating belt (first rotatable member) 302 as a rotatable heating member, and a pressing roller (second rotatable member) 304 as a pressing rotatable member forming a nip N between an outer peripheral surface of the heating belt 302 and the heating belt 302. The pressing roller 304 has a function also as a driving rotatable member for rotating the heating belt 302 as will be described hereinafter. Inside the heating belt 302, there is provided a heater (ceramic heater) 300 as a heating mechanism.

The heater 300 comprises an elongated thin-plate-like ceramic substrate elongated in a perpendicular direction to the sheet of the drawing of FIG. 1 (front and back direction), and a heat generating resistor layer provided on the surface of the substrate, as basic elements. Such a heater 300 is a low thermal capacity heater which is heated steeply by the electric power supply from a voltage source 309 to the heat generating resistor layer.

The heater 300 is fixed to a heater holder 301 as a supporting member. The heater holder 301 has a trough like shape having a substantially half-arc cross-section and is a heat insulation member of heat resistive resin material or the like elongated in the direction perpendicular to the sheet of the drawing of FIG. 1. The heater 300 is fitted into a groove portion formed in the lower surface of heater holder 301 along the length thereof and is fixed by a heat resistive adhesive, with the heater surface side facing downward. Designated by 303 is a stay provided inside of heater holder 301 to support the heater holder 301.

The heating belt 302 is made of a heat resistive film, for example, and is loosely fitted around the heater holder 301 including the heater 300. The heating belt 302 has a composite layer in order to improve a quick start property by reducing the thermal capacity as follows. The belt comprises a base layer of metal such as SUS or Ni, having a film thickness of not more than 100 μm, preferably 20-50 μm. The outer peripheral surface thereof is coated with a heat resistive rubber such as silicone rubber or fluorine-containing rubber, or an elastic layer of a foam member of silicone rubber. The outer peripheral surface thereof is further coated with PTFE, PFA or the like layer having a thickness of approx. 5-50 μm. An inner surface of the base layer is provided with a protection layer of PI (polyimide) or the like having a thickness of several μm to reduce a sliding friction between the heater 300 and the metal layer of the heating belt 302.

The pressing roller 304 comprises a core metal 304*a*, and an elastic layer 304*b* of heat resistive rubber such as silicone rubber or fluorine-containing rubber or a foam member of silicone rubber, and the opposite end portions of the core metal 304*a* are rotatably supported by side plates 400, 401. As shown in FIG. 2, above the top side of the pressing roller 304, the heater 300, the heater holder 301, the heating belt 302 and an assembly of the stay 303 are provided extended in parallel with the pressing roller 304 with the heater 300 side facing downward. The stay 303 is urged toward the pressing roller 304 by a variable pressure mechanism 500 which will be described hereinafter. By this, the lower surface (FIG. 2) of the heater 300 is press-contacted toward the outer peripheral surface of pressing roller 304 through the heating belt 302 against the elastic of the elastic layer 304*b* to form a nip N having a predetermined width.

A temperature of the heating belt 302 is monitored by a thermister 307 as a temperature detecting means outputting a detection signal to a controller (CPU) 308 of the control device. The controller 308 adjusts a current applied to the heater 300 by the voltage source 309 on the basis of the signal of the thermister 307, so that the heating belt 302 keeps a predetermined target temperature during the fixing operation.

In the state that the temperature of the heating belt 302 is controlled, the recording material carrying the toner image is fed into the nip N, and the unfixed toner image is heated and pressed so that the toner image is fixed on the recording material. The recording material after the fixing is separated from the heating belt 302, and is discharged from the nip N along a separation guide 306 provided downstream of the nip N in the feeding direction. The separation guide 306 is disposed spaced from the heating belt 302 so that the recording material discharged from the nip N is not wrapped around the heating belt 302 and so that the heating belt 302 is not damaged. Such a separation guide 306 is engaged with a part of a flange 305 which will be described hereinafter, and is fixed by an urging means such as a spring.

Figure 3:
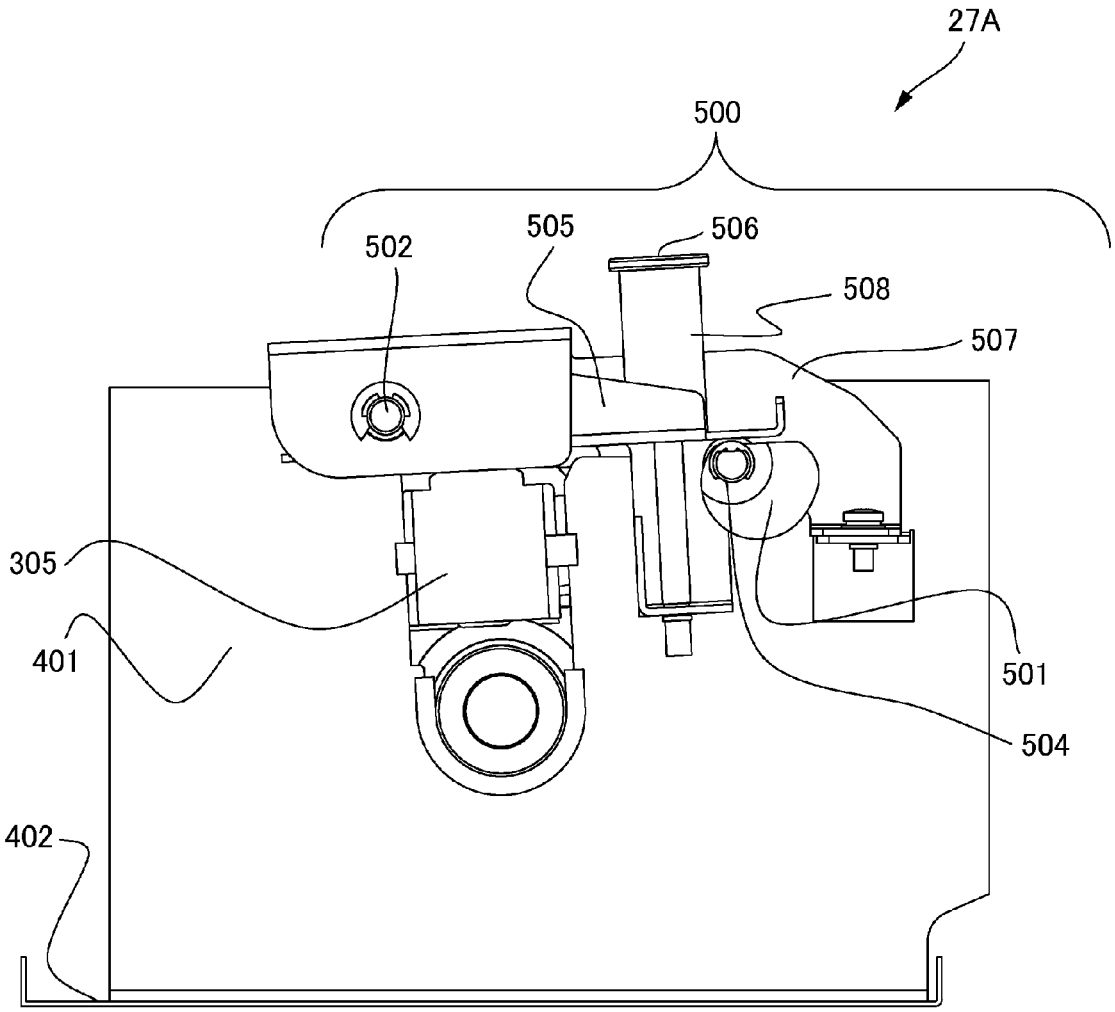
FIG. 3 is a schematic side view of a heating unit of the fixing device.
Figure 4:
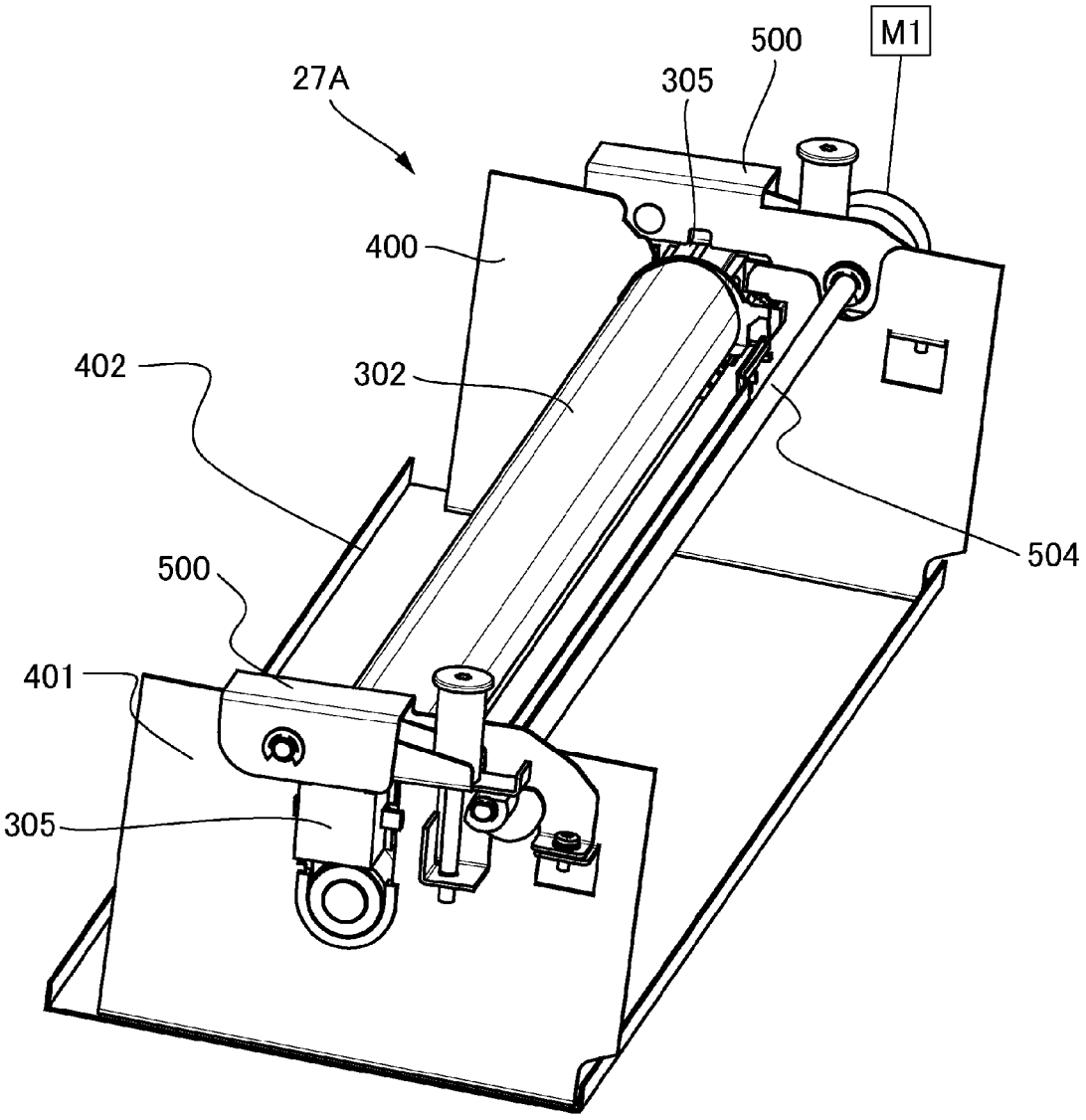
FIG. 4 is a schematic perspective view of a heating unit of the fixing device.

The flange 305 is supported by the side plates 400 and 401 constituting a frame (case) of the heating unit 27A as shown in FIGS. 3 and 4, and is movable toward and away from the pressing roller 304. The flange 305 is provided with a regulating member for supporting opposite end portions (rotation axial direction of the heating belt 302) of stay 303 and the heater holder 301 and for regulating a configuration in the circumferential direction and a movement in the longitudinal direction of the heating belt 302.

The heating belt 302 supported by such a flange 305 is urged toward the pressing roller 304 by the variable pressure mechanism 500 shown in FIGS. 3 and 4. The variable pressure mechanism 500 is provided at each of the opposite ends of the heating belt 302, and comprises a pressing cam 501, a pressing member rotational shaft 502, a pressing cam rotational shaft 504, a pressing member 505, a pressing adjusting screw 506, pressing supporting plate 507 and an urging spring 508.

The pressing member 505 and the pressing supporting plate 507 are supported by the side plates 400, 401 through the pressing member rotational shaft 502, and the pressing member 505 can move rotatably relative to the pressing supporting plate 507. The pressing supporting plate 507 is fixed to the side plates 400, 401. To the pressing supporting plate 507, the pressing adjusting screw 506 is fastened, and by rotating the pressing adjusting screw 506, a seat of the pressing adjusting screw 506 contracts the spring of the urging spring 508 to increase the spring load applied to the pressing member 505. The pressing member 505 is rotatably supported relative to the pressing supporting plate 507 as described above, and therefore, the compressive force of the urging spring 508 produces a moment about the pressing member rotational shaft 502.

The pressing member 505 is contacted to the flange 305. Therefore, the moment produced in the pressing member 505 pushes the flange 305 toward the pressing roller 304 to form the above-described nip N between the pressing roller 304 and the heating belt 302.

In order to release the pressure, the pressing cam 501 eccentric by a predetermined amount is rotated to push the pressing member 505 up. The pressure is released by rotating the pressing cam 501 until the pressing member 505 and the flange 305 becomes non-contacted relative to each other. The pressing cam 501 is rotated by a motor M1 as a driving source. The pressing cams 501 are provided at the opposite sides of the fixing belt 302 and are fixed to the opposite end portions of the pressing cam rotational shaft 504 with the same phase, so that they are rotated with the same phase by the motor M1. By this, the variable pressure mechanisms 500 at the opposite sides of heating belt 302 can be actuated to switch between the pressing and releasing states to the pressing roller 304. The normal pressure is 300 N, for example.

When the image forming operation starts, the variable pressure mechanisms 500 press-contact the heating belt 302 to the pressing roller 304 to form the nip N. On the other hand, when the image forming operation is finished, the variable pressure mechanisms 500 releasing the heating belt 302 from the pressing roller 304, and the released state is kept.

Figure 5:
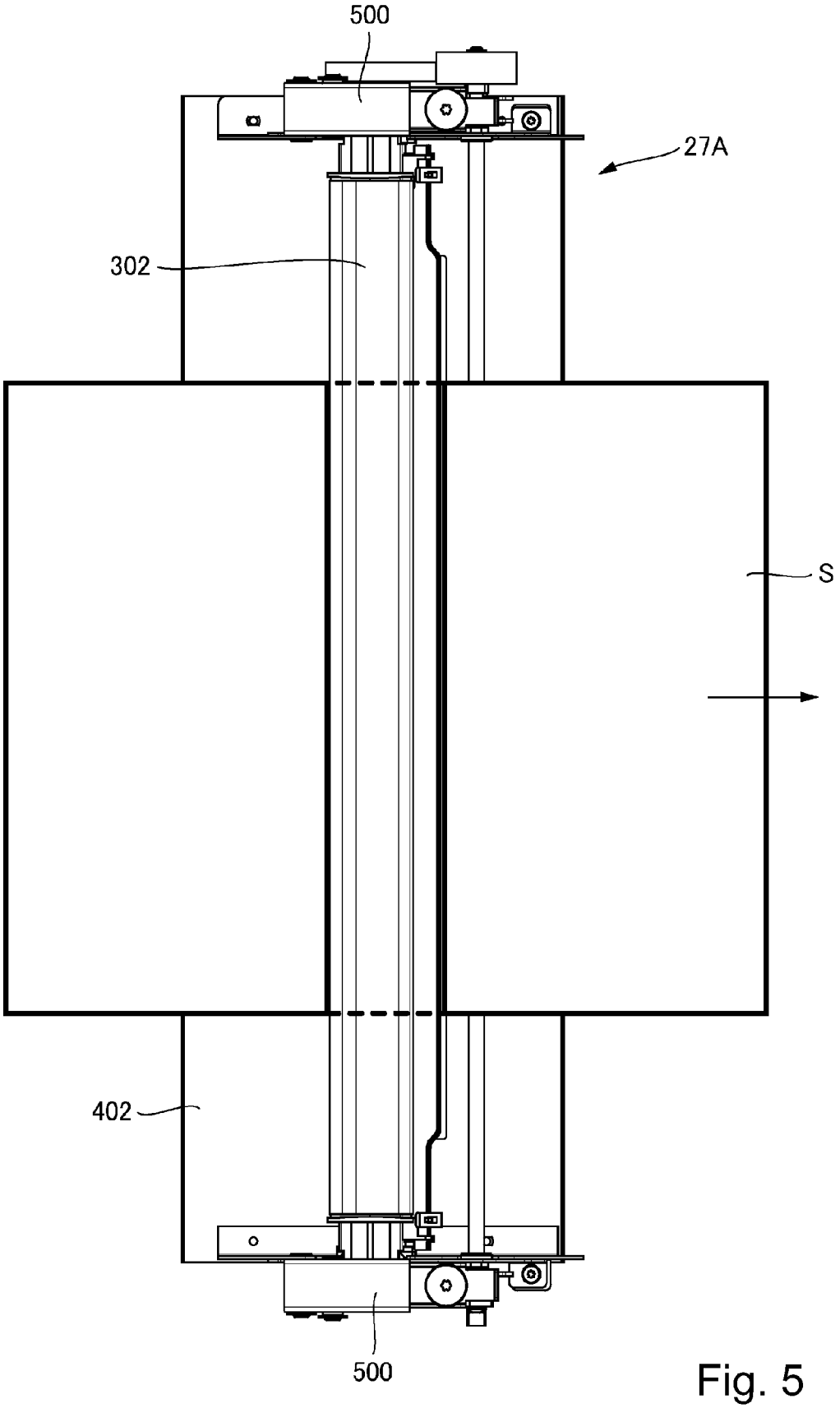
FIG. 5 is a schematic top plan view of the fixing device in which the recording material is passing the nip.

FIG. 5 shows the fixing device during the image forming operation. During the image forming operation, the nip N is formed between the heating belt 302 and the pressing roller 304 by the variable pressure mechanisms 500, and the fixing step (fixing process) is completed by passing the recording material through the nip N. The edges of the recording material have small burrs produced by cutting, and the burrs flaw surface of the heating belt 302 during the fixing step at the position corresponding to the edges of the recording material, and the flaws may appear on the prints.

When the recording materials of the same size are continuously processed, a temperature difference occurs between the recording material passing portion of the surface of the heating belt 302 and the non-passing portion of the surface of the heating belt 302. Because the heat of heating belt 302 is consumed for the toner fixing in the passing portion, but it is not consumed in the non-passing portion. By the temperature difference, a surface speed of the heating belt 302 is higher in the non-passing portion region than in the passing portion region with the result of slippage in the lateral end portions of the recording material. Therefore, the surface of the heating belt 302 results in having fine unsmoothness (fine pits and projections, damage by the lateral edges or edge flaw).

[Reciprocating Mechanism]

Figure 6:
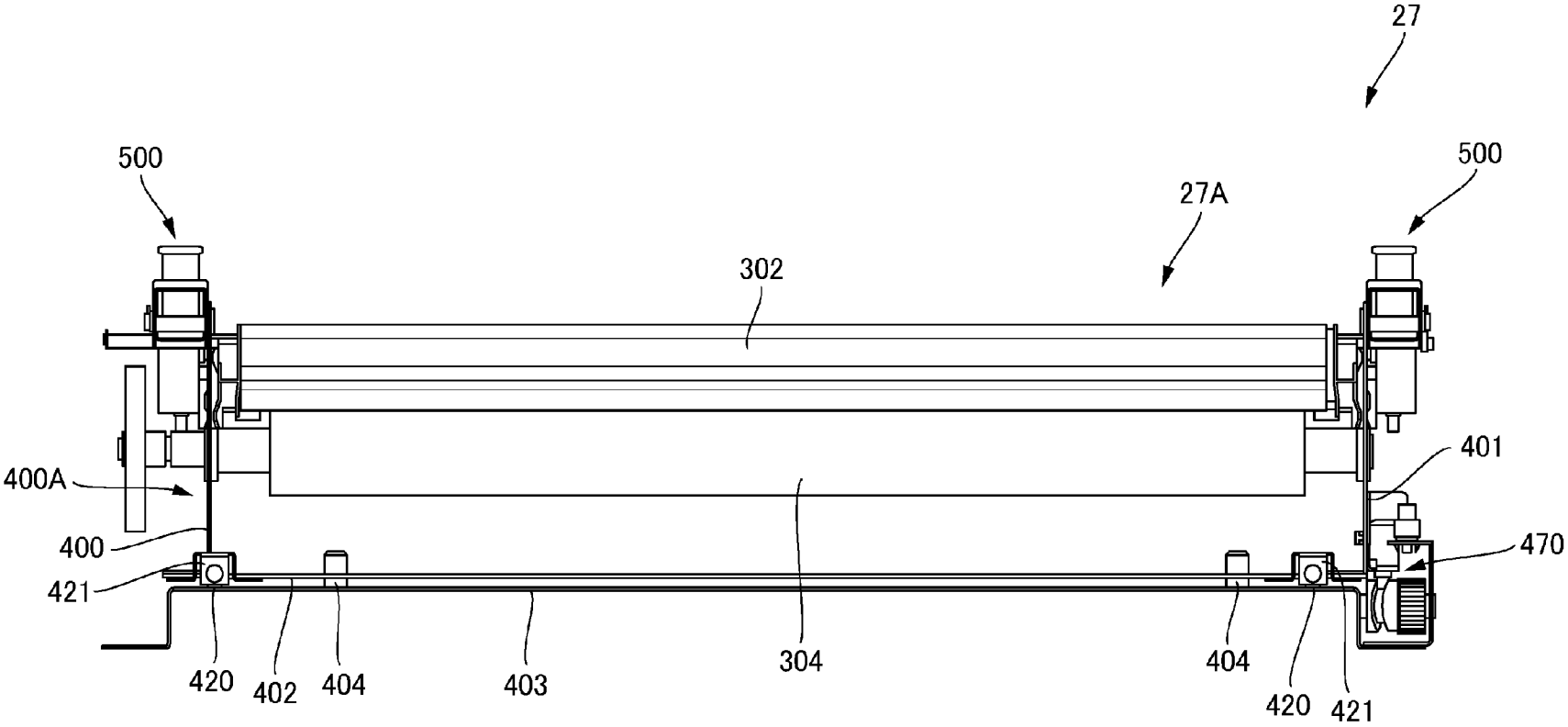
FIG. 6 is a schematic front view of the fixing device.
Figure 7:
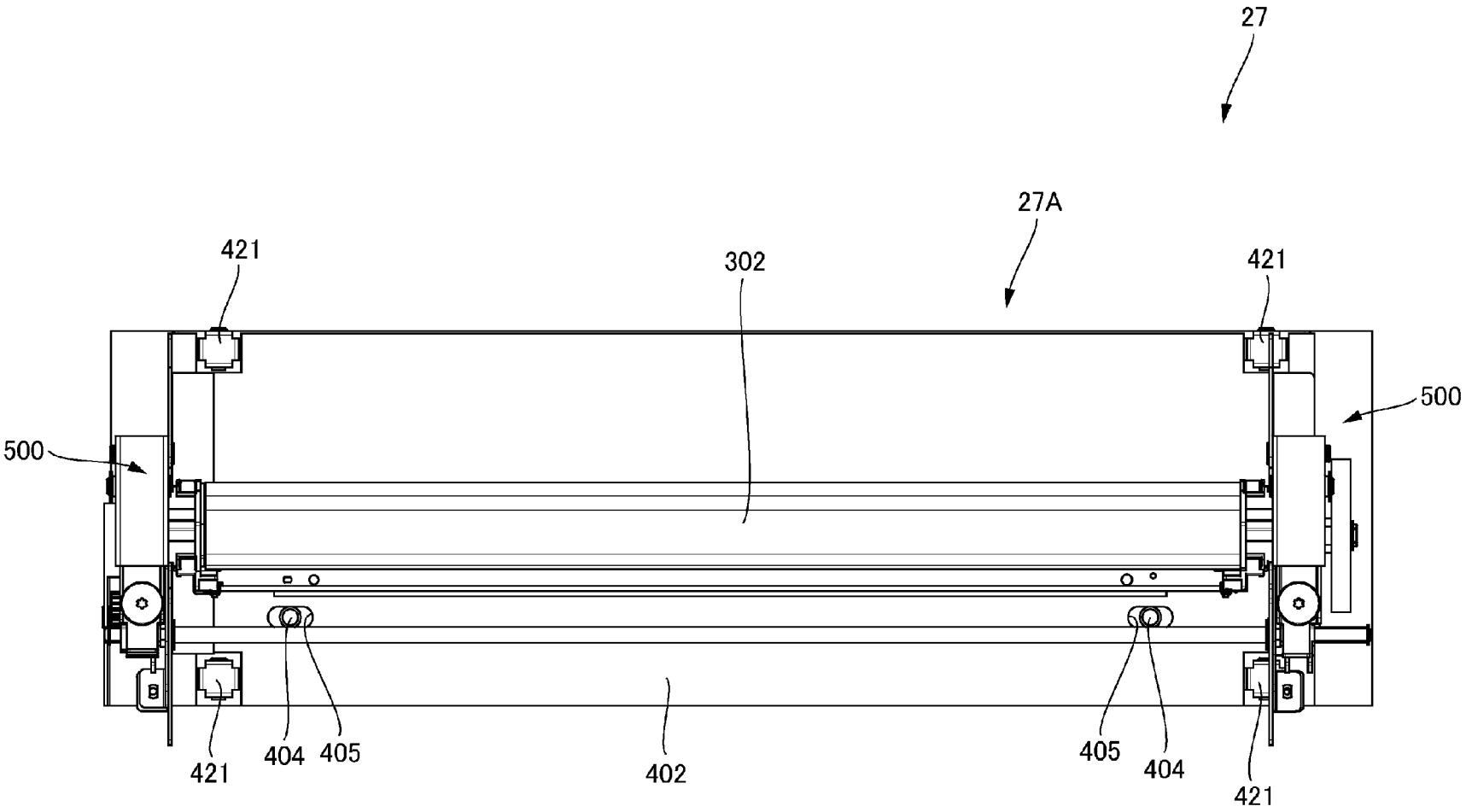
FIG. 7 is a schematic top plan view of the fixing device.
Figure 8:
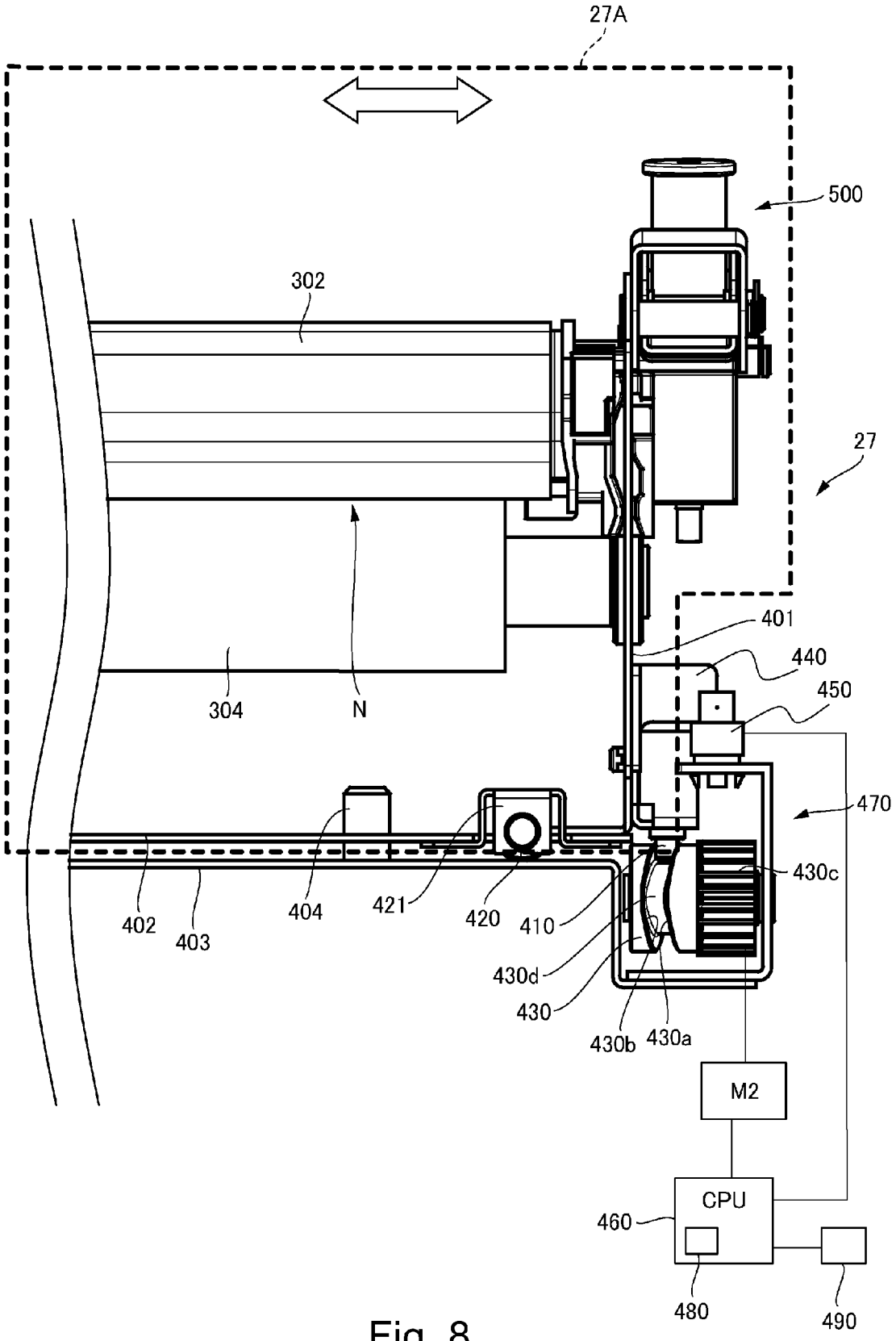
FIG. 8 is a view of a right-hand end portion of FIG. 6.

In this embodiment, in order to reduce such edge flaws, the base plate which is a supporting portion for the heating unit 27A is reciprocated in the longitudinal direction (widthwise direction of the recording material or direction perpendicular to the feeding direction of recording material). Referring to FIG. 6 through FIG. 8, a reciprocating mechanism for reciprocation controlling will be described.

As shown in FIGS. 6 and 7, the heating unit 27A of the fixing device 27 includes a frame 400A having the front side plate 400, the rear side plate 401 and a bottom plate 402. Thus, the heating belt 302 and the pressing roller 304 including the assembly such as the heater 300 are supported by the frame 400A. In this embodiment, the front side and the rear side are based on the installed state of the image forming apparatus, and the front side is the side where the user operates the image forming apparatus, and the rear side is the opposite side.

At each of four corners of the bottom plate of the frame 400A, a roller 420 is rotatably provided using a bearing 421, and the surface of the roller 420 is slightly projected downwardly beyond the bottom plate 402. In addition, the bottom plate 402 is provided with two elongated holes 405 extending in the widthwise direction (longitudinal direction, left-right direction of FIG. 6 through FIG. 8) as an engaged portion, the elongated hole 405 being spaced from each other and being provided at a sheet discharging side.

The frame 400A of such a heating unit 27A is a part of the fixing device 27, and is support by the base plate 403 movably in the widthwise direction relative to the main assembly of the image forming apparatus. More particularly, by the rollers 420 provided in the bottom plate 402 rolls on the base plate 403, the frame 400A and the heating unit 27A can move in the widthwise direction relative to the base plate 403. In this manner, the bottom plate 402 is supported by the rollers 420 on the base plate 403, and therefore, the rollers 420 rotate at the time of reciprocation in which the sliding resistance is minimized.

The reciprocation base plate 403 is provided with two shafts 404 as an engaging portion in the sheet discharging side so as to engage with the elongated holes 405 of the bottom plate 402, respectively. Therefore, the frame 400A is guided in the widthwise direction by the engagement between the shaft 404 and the elongated hole 405. A movement distance in the widthwise direction is regulated by a length of the elongated hole 405 measured in the widthwise direction.

A reciprocating mechanism 470 controls the reciprocal moving operation. Referring to FIG. 8, the reciprocating mechanism 470 will be described. The reciprocating mechanism 470 is disposed at the side plate 401 side in the rear side of the fixing device 27. More specifically, the reciprocating mechanism 470 includes a cam 430 as an inclination member, a shaft 410 as an engageable member, and a motor M2 as driving means (operating device).

The cam 430 is provided on one of the heating unit 27A and the supporting portion, more particularly on the base plate 403 which is a supporting portion in this embodiment, and is provided with a pair of inclined surfaces 430*a*, 430*b* inclined relative to the widthwise direction. The cam 430 has a substantially cylindrical shape and is integral with the gear 430*c* to which a rotational force is applied from the motor M2, and it is provided with V-like grooves 430*d* as seen from a diametrically outside over the entire cylindrical outer peripheral surface. Opposite side surfaces of the groove 430*d* constitute the inclined surfaces 430*a*, 430*b*, respectively. The inclined surfaces 430*a*, 430*b* extend in parallel with each other, and are waved at regular intervals when they are expanded.

The shaft 410 is provided on the other of the heating unit 27A and the supporting portion, more particularly on the side plate 401 of the heating unit 27A in this embodiment, and is engaged with the inclined surfaces 430*a*, 430*b* of the cam 430. That is, the shaft 410 is inserted into the groove 430*d* of cam 430, and the outer peripheral surface of the shaft 410 is contacted to at least one of the inclined surfaces 430*a*, 430*d*.

The motor M2 causes a relative movement between the cam 430 and the shaft 410 to reciprocate the heating unit 27A through the engagement between the shaft 410 and the inclined surfaces 430*a*, 430*b*. In this embodiment, the motor M2 is a pulse motor, and is driven in accordance with a pulse number fed from the controller (CPU) 460 of the control device so as to rotate the cam 430 through an amount (angle) corresponding to the pulse number. The controller 460 may be common with the above-described controller 308 for controlling the electric power supply to the heater 300.

By the relative rotation of the cam 430 relative to the shaft 410, the engaging position between the shaft 410 and the inclined surfaces 430*a*, 430*b* changes. Since the inclined surfaces 430*a*, 430*b* are inclined relative to the widthwise direction as described above, the changing of the engaging position moves the shaft 410, and therefore the heating unit 27A fixed to the shaft 410, in the widthwise direction. Here, the heating unit 27A is movable only in the direction along the elongated hole 405 of the bottom plate 402 as described hereinbefore, and therefore, the heating unit 27A defined by broken lines in FIG. 8 moves only in the widthwise direction.

In addition, the pair of inclined surfaces 430*a*, 430*b* is in the form of a wave continuously extending in the circumferential direction as described above, and therefore, the rotation of the cam 430 reciprocates the shaft 410 in the widthwise direction along the wave shape. With such a structure of this embodiment, the reciprocation control (reciprocation moving operation) of the heating unit 27A is carried out.

The cam 430 as the inclination member may be provided on the heating unit 27A side, and the shaft 410 as the engageable member may be provided on the base plate 403 side (supporting portion).

In this manner, in this embodiment, the shaft 410 is engaged with the groove 430*d* formed in the cam 430, and the cam 430 is rotated so that the reciprocation control (reciprocation moving operation) of heating unit 27A is effected. It is unnecessary to employ an urging means such as spring to urge the cam 430 to the cam surface, and therefore, the required torque can be reduced. By this, the driving structure can be downsized, and therefore, the space required by the reciprocating mechanism can be reduced.

Such a reciprocation control (reciprocation moving operation) is carried out for each recording material. That is, the controller 460 moves the heating unit 27A through a predetermined amount for each passage of the recording material through the nip N. In this embodiment, the heating unit 27A is moved during the recording material passing through the nip N after the trailing edge of recording material depart the secondary transfer portion. The movement distance is preferably approx. 0.1-0.2 mm per sheet.

The frequency of the reciprocation controls (reciprocation moving operations) may be one for each sheet, of one for every 2, 3 or another plurality of sheets. The heating unit 27A is moved at every predetermined number of sheets passing the nip N. The predetermined number of sheets may be constant, or may be variable depending on the kind, the size of recording material, the number of the processed sheets or the like.

In this embodiment, the inclination angle of inclined surfaces 430*a*, 430*b* of cam 430 are selected such that the movement distance per one recording martial is 0.15 mm in the range other than the moving direction switching range. The range of reciprocation control (reciprocation moving operation) is approx. 4-5 mm, for example. In other words, the heating unit 27A movement by increment of 0.15 mm within the movement range of approx. 4-5 mm.

The timing of the execution of the reciprocation control (reciprocation moving operation) is in the period in which no recording material is in the nip N, that is, so-called sheet interval, but in this embodiment, the timing is selected as described above. More particularly, it is after the trailing edge of recording material departs the secondary transfer portion, before the leading end reaches the nip N and during the period in which the recording material is nipped only by the nip N. This is because by the reciprocation control (reciprocation moving operation) during a sheet interval may result in the reduction of the productivity. In addition, if the heating unit 27A carries out the reciprocating operation while the recording material is nipped by the secondary transfer portion and the nip N of the heating unit 27A, the nip N deviates the recording material in the widthwise direction with the result of transfer defect. Therefore, in this embodiment, the timing of the execution of the reciprocating operation is selected as described above.

In addition, in this embodiment, there is provided a position sensor 450 as a position detecting means for detecting a position of the heating unit 27A with respect to the widthwise direction. The position sensor 450 is fixed on the base plate 403 and includes a light emitting portion and a light receiving portion for receiving the light emitted by the light emitting portion, the light emitting portion and the light receiving portion being disposed opposed to each other. In addition, a sensor flag 440 is provided on the rear side plate 401 of heating unit 27A. The sensor flag 440 enters between the light emitting portion and the light receiving portion of the position sensor 450 to block the light from the light emitting portion, by which the position sensor 450 detects a predetermined position of heating unit 27A with respect to the widthwise direction. The detection signal is fed to the controller 460, and the controller 460 controls the motor M2 on the basis of the signal.

In this embodiment, a home position (HP position) is the position at which the sensor flag 440 just block the light of position sensor 450 by the movement of the heating unit 27A from a position not blocking the light of the position sensor 450. In position HP, a widthwise center portion of recording material entering the nip N and a widthwise center portion of the heat generation width of heating belt 302 (widthwise center portion of heating region) are substantially aligned with each other.

The edge flaw of the surface of the heating belt 302 produced by a recording material of a size may appear on the image on the recording material having a size larger than that. If, on the other hand, the subsequent has a larger size, the edge flaw does not appear thereon. For this reason, of above-described reciprocation control (reciprocation moving operation) is unnecessary for the recording material having a maximum width usable with the image forming apparatus. Correspondingly, the device can be downsized.

If after the fixing process of the recording material having the maximum width, the next recording material has a width within width range having caused the edge flaw produced by the maximum width sheet does not appear on the next sheet.

Figure 9:
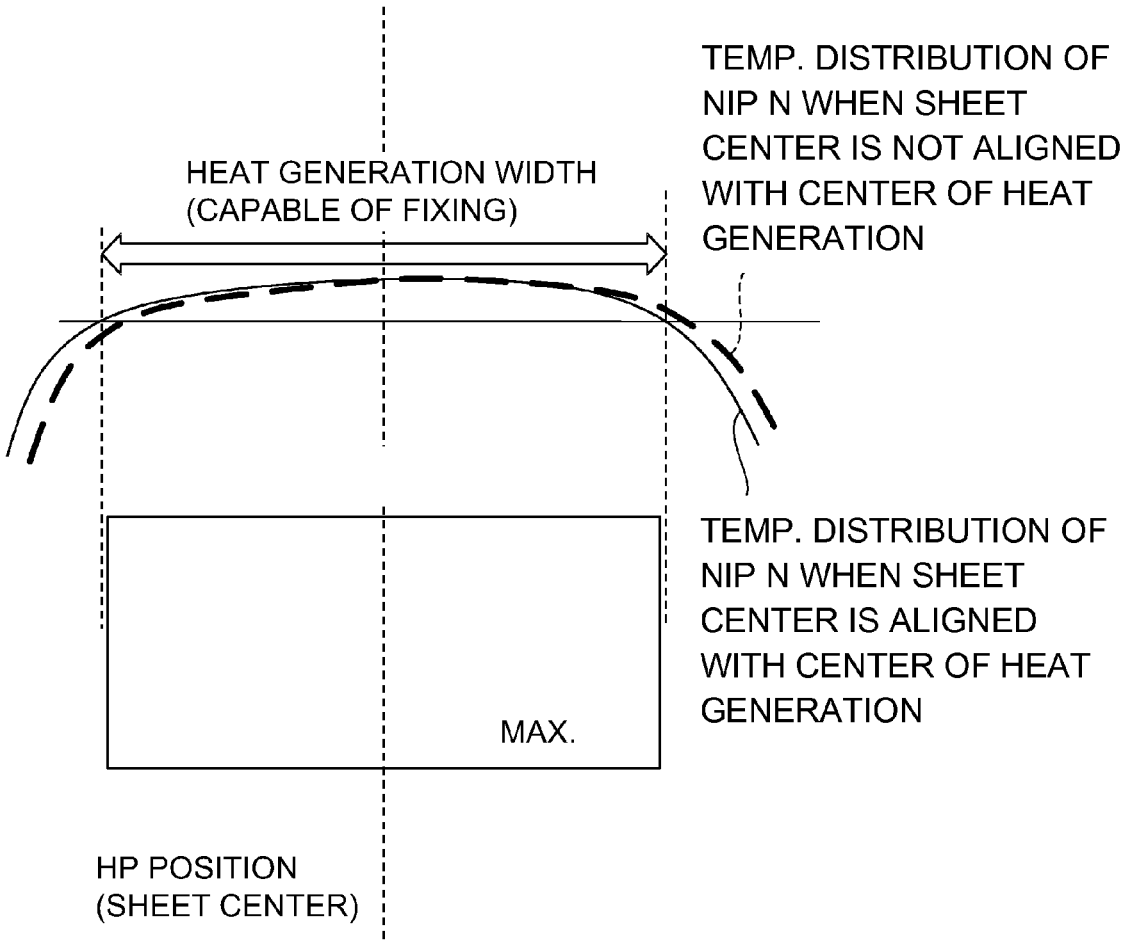
FIG. 9 is a schematic view illustrating a relation between a width of a heat generation and a maximum width size of the recording material.

However, when the fixing process is carried out for the recording material having the maximum width size in a state that the heating unit 27A is at an end portion of the reciprocation range, the widthwise center portion of a heating region of a heating belt 302 is not aligned with the widthwise center portion of recording material. Here, when the heating region of the heating belt 302 is set corresponding to the width of the recording material having the maximum width, the maximum width recording material may be partly outside the heat generation width if the widthwise position of the heating unit 27A is deviated by the reciprocation control (reciprocation moving operation), as shown in FIG. 9. As a result, the fixing property may not be assured for an image at the widthwise end portion of recording material. In addition, in the case that the fixing process is carried out continuously on the maximum width recording materials, the maximum width recording material may be partly outside the fixable heat generation width, similarly.

In view of the above, in this embodiment, when the width of the recording material is larger than a predetermined value, the reciprocation control (reciprocation moving operation) is not executed, and the heating unit 27A is placed at a predetermined position with respect to the widthwise direction. On the other hand, when the width of the recording material is not more than the predetermined value, the reciprocation control (reciprocation moving operation is carried out. In heating unit 27A is moved every predetermined number of sheet processings of the recording materials through the nip N. In order to accomplish this, the controller 460 comprises an information acquiring portion 480 for acquiring the information of the width of the fed recording material. In this embodiment, the information acquiring portion 480 acquires the width from the information set by the user for the sheet size on an operation panel 490. The information of the width of the recording material may be acquired from the detecting means provided in the apparatus may be acquired from the information of the recording material inputted from an external information terminal.

For example, when the user designates A4 size on the operating portion 490, the information acquiring portion 480 acquires the width of the A4 size recording material. The controller 460 controls the reciprocation control (reciprocation moving operation) of the heating unit 27A on the basis of the width information acquired by the information acquiring portion 480. More particularly, if the width is not more than a predetermined value, the reciprocation control (reciprocation moving operation) is carried out, otherwise, the reciprocation control the reciprocation moving operation) is not carried out, and place the heating unit 27A in the predetermined position.

It is not inevitable that the controller 460 compares the acquired width with a predetermined length. For example, in an alternative structure, a corresponding relation between the size of recording material and whether to effect the reciprocation control (reciprocation moving operation) is stored beforehand in a table (memory), and the determination is made by the table.

Here, the predetermined width may be properly selected depending on the device and/or a usage thereof, but in this embodiment, the width of the maximum width recording material is larger than the predetermined width, and the other recording materials have the width not more than the predetermined width. The maximum width recording material is the one usable with the device. In the case that the maximum width recording material is hardly used, or in the case that the image quality on the maximum width recording material is not concerned, the width less than the maximum width may be included in the range larger than the predetermined width.

The predetermined position of heating unit 27A is the above-described HP position in this embodiment. That is, the predetermined position is such a position that the widthwise center portion of the recording material fed to the nip is aligned with the widthwise center portion of heating region (fixable heat generation width) of the heating belt 302. The predetermined position may be properly selected depending on the device and/or a usage thereof, and it may be a position where the widthwise center portion of recording material fed to the nip is not aligned with the widthwise center portion of the heating region of the heating belt 302. For example, it may be deviated by several mm. In addition, in the case that the size larger than the predetermined includes a plurality of sizes of the recording materials, the predetermined position may be different depending on the sizes.

In summary, in this embodiment, when the width information acquired by the information acquiring portion 480 is smaller than the maximum width capable of passing through the nip N, the heating unit 27A is moved for each of the predetermined number of recording materials passing the nip N by the above-described reciprocation control (reciprocation moving operation). On the other hand, when the width information acquired by the information acquiring portion 480 is the maximum width, the reciprocation control (reciprocation moving operation) is not carried out, and the heating unit 27A is placed in the HP position in the widthwise direction. More specifically, when the heating unit 27A is deviated from the HP position by the past reciprocating operations or the like, the heating unit 27A is moved to the HP position before the maximum width recording material is fed to the nip N. When the heating unit 27A is at the HP position after the passing of the immediately prior recording material, the heating unit 27A is kept at the HP position without movement.

In the case of this embodiment, while the recording materials having the predetermined width larger than a predetermined width as acquired by the information acquiring portion 80 are continuously fed into the nip N, the heating unit 27A is not moved from the predetermined position when the recording material passes the nip N. In this embodiment, while the maximum width recording materials are continuously fed, the reciprocation control (reciprocation moving operation) is not carried out, but the heating unit 27A is placed in the HP position.

In this manner, when a job (fixing process) is carries out for the maximum width recording materials, the widthwise center portion of recording material can be aligned with the widthwise center portion of heat generating region, if the heating unit is moved to the HP position or the heating unit is kept at the HP position.

Figure 10:
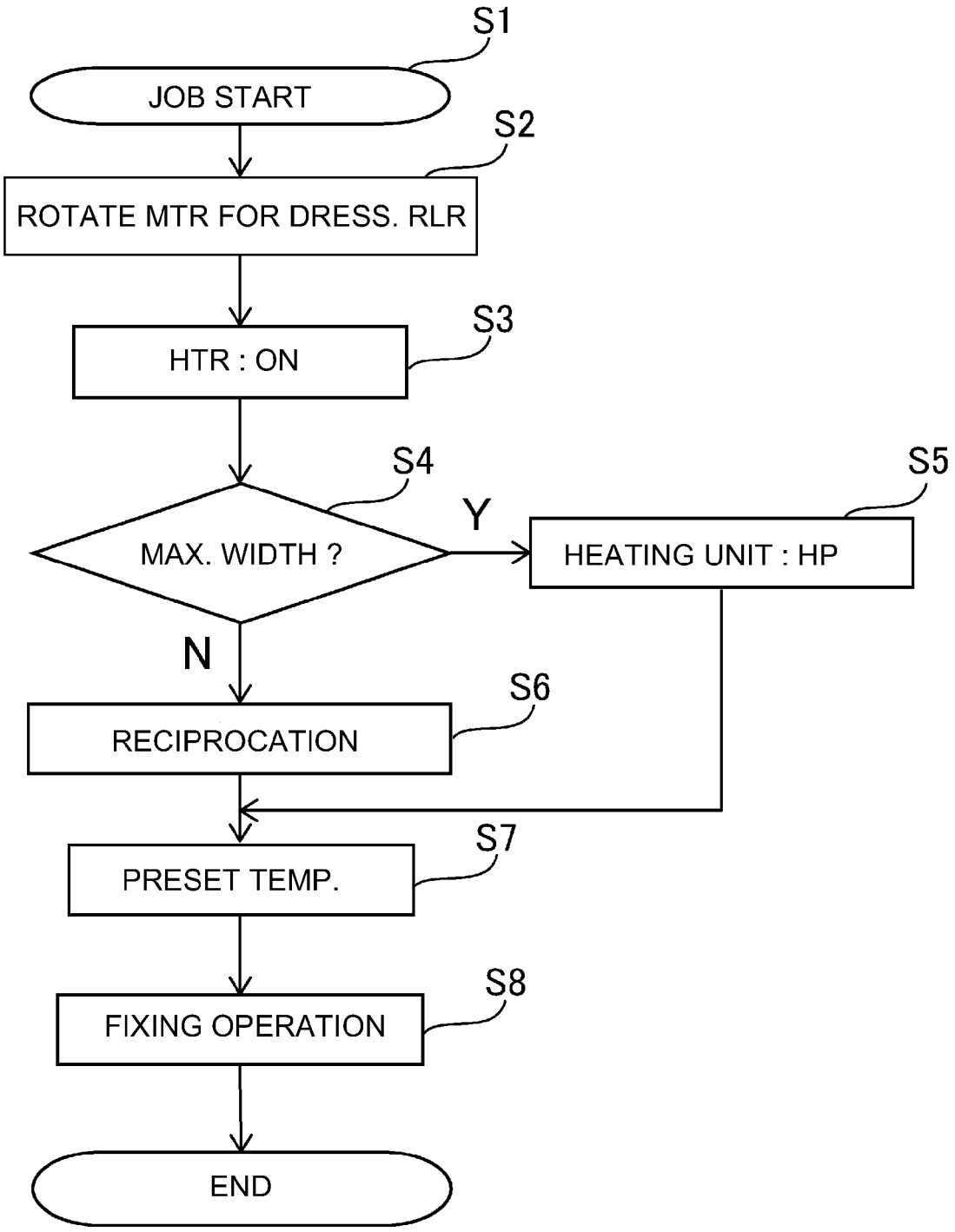
FIG. 10 is a flow chart showing an example of a control flow for the fixing device.

Referring to FIG. 10, such an example of control of this embodiment will be described. When the job starts (S1), the motor M1 of the pressing roller 304 is rotated (S2), and the heater 300 is supplied with electric power (S3). Then, the controller 460 discriminates whether or not the width of the recording material acquired by the information acquiring portion 480 is the maximum width (S4). If it is a maximum width recording material, the reciprocation control (reciprocation moving operation) is not executed, and the heating unit 27A is moved to or kept at the HP position (S5). On the other hand, if it is not a maximum width recording material (S4), the reciprocation control (reciprocation moving operation) of the heating unit 27A is executed (S6). Thereafter, when the temperature of the heating belt 302 reaches the predetermined level (target temperature) (S7), the fixing operation is started (S8).

In the control shown in FIG. 10, the rotation of the motor M1 for the pressing roller 304 and the electric power supply to the heater 300 are started earlier than the reciprocation control (reciprocation moving operation) because the heating of the heating belt 302 to the target temperature requires longer time than the reciprocation control (reciprocation moving operation the. The order of such controls is determined so as to minimize the required time to the first copy FCOT (first copy time), and therefore, the order may be different depending on the structure of fixing device.

In this embodiment, when the width of the recording material is not more than the predetermined width (less than the maximum width), the reciprocation control (reciprocation moving operation) of the heating unit 27A is executed after each predetermined number (one in this embodiment) of sheets passing the nip. Therefore, lateral edges of the recording materials do not pass the same portions of the nip N, and the surface of the heating belt 302 is protected from the edge flaw.

On the other hand, when the width of the recording material is larger than the predetermined width (maximum width in this embodiment), the widthwise position of the heating unit 27A is placed at the predetermined position (HP position in this embodiment). Therefore, the width (dimension measured in the widthwise direction of the heating region) of the heating belt 302 is not required to be too long. That is, since the center portion of maximum width recording material and the center portion of the heating region of the heating belt 302 are aligned with each other, the heating region may be determined to meet the maximum width. As a result, the lengths of the heating belt 302 and the heater 300 measured in the widthwise direction is not required to be longer than necessary, despite the structure with which the reciprocation control (reciprocation moving operation) of the heating unit 27A is possible, and therefore, the upsizing of the device can be avoided.

In addition, in this case, by the feeding of the maximum width recording materials through the nip N, the edge flaws may results on the surface of the heating belt 302, but the edge flaws are produced at the positions corresponding to the end portions of maximum width recording material. Therefore, the produced edge flaws are outside, with respect to widthwise direction, the next recording material, are not transferred onto said next recording material.

When this embodiment, the relative movement is caused between the cam 430 and the shaft 410, and the heating unit 27A is reciprocated through the engagement between the shaft 410 and the pair of the inclined surfaces 430*a*, 430*b* of the cam 430. Therefore, no spring or the like is required in order to move the heating unit 27A. Therefore, the motor is not required to drive the cam against an urging force of the spring, and the torque required for the rotation of the cam 430 may be relatively small, thus accomplishing the reciprocating mechanism with the small space.

According to this embodiment, as described in the foregoing, the edge flaw of heating belt 302 is reduced, and therefore, the image quality and the lifetime can be improved, without upsizing the device.

Other Embodiments

The present invention is not limited to the foregoing embodiment. In the above-described embodiment, the fixing device is an on-demand type fixing device using a film-like heating belt as the rotatable heating member. The rotatable heating member may be a roller or belt. The heating mechanism in the foregoing embodiment is a ceramic heater, but it may be a halogen heater, or an induction heating mechanism using an excitation coil (IH).

The positional relation between the sensor flag and the position sensor may be the opposite. More particularly, the position sensor may be provided on the reciprocation movement side, and the sensor flag is provided on the non-reciprocation side. The means for detecting the position of the heating unit with respect to the widthwise direction may be the combination of the sensor flag and the position sensor, or may use an encoder. For example, an encoder is provided on the rotation shaft of the motor, and the rotation amount of the encoder is counted, and the home position can be made detected, by which the position of the heating unit from the home position can be detected. It will suffice if the position of the heating unit with respect to the widthwise direction can be detected.

The reciprocating mechanism have used the cam and the shaft in the foregoing, but another structure is usable. For example, the inclination member may be a screw shaft having an outer peripheral surface male screw, and the engageable member may be a nut screwed on the screw shaft. It will suffice if the reciprocation movement can be carried out.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195664/2012 filed Sep. 6, 2012, which is hereby incorporated by reference.

What is claimed is:

1. A fixing device comprising:

a base plate;

a fixing unit supported by the base plate, including a first rotatable member, and a second rotatable member which form a nip to fix a toner image on a sheet, a side plate, and an engageable member attached to the side plate;

a moving mechanism, supported by the base plate, configured to incrementally move said fixing unit in a widthwise direction of said fixing unit, said moving mechanism comprising a cam engaging the engageable member; and a control portion configured to control said moving mechanism so as to cause said fixing unit to repetitively make an incremental movement in one widthwise direction for each predetermined number of sheets to a predetermined limit and then to cause said fixing unit to repetitively make an incremental movement in an opposite widthwise direction opposite the one widthwise direction for each predetermined number of sheets to a predetermined limit, wherein said control portion causes the incremental movement whenever said fixing unit fixes the toner image on a predetermined width sheet having a width smaller than a width of a maximum width sheet usable in said device, and said control portion stops the incremental movement and places said fixing unit at a predetermined position whenever said fixing unit fixes the toner image on the maximum width sheet.

2. A device according to claim 1, wherein said first rotatable member is contactable with the toner image on the sheet, and wherein when said fixing unit fixes the toner image on the maximum width sheet, opposite side edges of the maximum width sheet contact said first rotatable member in a region where the predetermined sheet is not capable of contacting, by placing said fixing unit at the predetermined position.

3. A device according to claim 2, further comprising a sensor configured and positioned to detect a position of said fixing unit with respect to the widthwise direction, wherein said control portion places said fixing unit in the predetermined position on the basis of an output of said sensor.

4. A device according to claim 1, further comprising a heating mechanism configured to heat said first rotatable member, wherein said control portion places, in the fixing operation for the maximum width sheet, said fixing unit such that a center of the maximum width sheet with respect to the widthwise direction is substantially aligned with a center, with respect to widthwise direction, of a heating region of said first rotatable member by said heating mechanism.

5. A device according to claim 4, further comprising a sensor configured and positioned to detect a position of said fixing unit with respect to the widthwise direction, wherein said control portion places the fixing unit in the predetermined position on the basis of an output of said sensor.

6. A device according to claim 4, wherein said heating mechanism effects electromagnetic induction heating of said first rotatable member.

7. A device according to claim 1, wherein said control portion effects the incremental movement while the predetermined width sheet passes through the nip.

8. A device according to claim 1, wherein said first rotatable member is an endless belt contactable with the toner image on the sheet, and said second rotatable member is a driving roller configured to rotate said endless belt.

9. A fixing device comprising:

a base plate;

a fixing unit supported by the base plate, including a first rotatable member, and a second rotatable member which form a nip to fix a toner image on a sheet, a side plate, and an engageable member attached to the side plate;

a moving mechanism, supported by the base plate, configured to incrementally move said fixing unit in a widthwise direction of said fixing unit, said moving mechanism comprising a cam engaging the engageable member; and a control portion configured to control said moving mechanism so as to cause said fixing unit to repetitively make an incremental movement in one widthwise direction for each predetermined number of sheets to a predetermined limit and then to cause said fixing unit to repetitively make an incremental movement in an opposite widthwise direction opposite the one widthwise direction for each predetermined number of sheets to a predetermined limit, wherein said control portion causes the incremental movement whenever said fixing unit fixes the toner images on predetermined width sheets each having a width smaller than a width of a maximum width sheet usable in said device, and said control portion stops the incremental movement and places said fixing unit at a predetermined position whenever said fixing unit fixes the toner images on the maximum width sheets.

10. A device according to claim 9, wherein said first rotatable member is contactable with the toner image on the sheet, and wherein when said fixing unit fixes the toner images on the maximum width sheets, opposite side edges of the maximum width sheets contact said first rotatable member in a region where the predetermined sheets are not capable of contacting, by placing said fixing unit at the predetermined position.

11. A device according to claim 10, further comprising a sensor configured and positioned to detect a position of said fixing unit with respect to the widthwise direction, wherein said control portion places the fixing unit in the predetermined position on the basis of an output of said sensor.

12. A device according to claim 9, further comprising a heating mechanism configured to heat said first rotatable member, wherein said control portion places, in the fixing operation on the maximum width sheets, said fixing unit such that a center of the maximum width sheets with respect to the widthwise direction is substantially aligned with a center, with respect to widthwise direction, of a heating region of said first rotatable member by said heating mechanism.

13. A device according to claim 12, further comprising a sensor configured and positioned to detect a position of said fixing unit with respect to the widthwise direction, wherein said control portion places the fixing unit in the predetermined position on the basis of an output of said sensor.

14. A device according to claim 12, wherein said heating mechanism effects electromagnetic induction heating of said first rotatable member.

15. A device according to claim 9, wherein said control portion effects the incremental movement while the predetermined width sheet passes through the nip.

16. A device according to claim 9, wherein said first rotatable member is an endless belt contactable with the toner image on the sheet, and said second rotatable member is a driving roller configured to rotate said endless belt.

17. A control device for controlling a moving mechanism configured to incrementally move a fixing unit in a widthwise direction of said fixing unit, said fixing unit being supported by a base plate, said fixing unit including a first rotatable member, and a second rotatable member which form a nip to fix a toner image on a sheet, a side plate, and an engageable member attached to the side plate, and said moving mechanism being supported by the base plate, and comprising a cam engaging the engageable member, said control device comprising:

an information acquiring portion configured to acquire information corresponding to a width of the sheet; and a controller configured to control whether to operate the moving mechanism based on the information acquired by said information acquiring portion, wherein said controller controls the moving mechanism so as to cause the fixing unit to repetitively make an incremental movement in one widthwise direction for each predetermined number of sheets to a predetermined limit and then to cause the fixing unit to repetitively make an incremental movement in an opposite widthwise direction opposite the one widthwise direction for each predetermined number of sheets to a predetermined limit, and wherein said controller causes the incremental movement whenever the fixing unit fixes the toner image on a predetermined width sheet having a width smaller than a width of a maximum width sheet usable in the fixing unit, and said controller stops the incremental movement and places the fixing unit at a predetermined position whenever the fixing unit fixes the toner image on the maximum width sheet.

18. A device according to claim 1, wherein the predetermined number of the sheets is one.

19. A device according to claim 9, wherein the predetermined number of the sheets is one.

20. A device according to claim 17, wherein the predetermined number of the sheets is one.

* * * * *